US010193258B2

(12) United States Patent
Balser

(10) Patent No.: US 10,193,258 B2
(45) Date of Patent: Jan. 29, 2019

(54) TWO PIECE CLEAN BODY FEMALE ELECTRIC TERMINAL

(71) Applicant: Lear Corporation, Southfield, MI (US)

(72) Inventor: Michael Balser, Remscheid (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 15/728,164

(22) Filed: Oct. 9, 2017

(65) Prior Publication Data

US 2018/0183165 A1 Jun. 28, 2018

(30) Foreign Application Priority Data

Dec. 28, 2016 (DE) ..... 10 2016 125 764

(51) Int. Cl.

| | |
|---|---|
| ***H01R 4/18*** | (2006.01) |
| ***H01R 13/03*** | (2006.01) |
| ***H01R 13/11*** | (2006.01) |
| ***H01R 13/18*** | (2006.01) |
| ***H01R 13/434*** | (2006.01) |

(52) U.S. Cl.

CPC ..... *H01R 13/112* (2013.01); *H01R 13/18* (2013.01); *H01R 13/434* (2013.01); *H01R 4/185* (2013.01); *H01R 13/03* (2013.01)

(58) Field of Classification Search

CPC ..... H01R 13/18; H01R 13/113
USPC ..... 439/839, 846
See application file for complete search history.

(56) References Cited

U.S. PATENT DOCUMENTS 4,540,235 A * 9/1985 Lolic ..... H01R 13/11 439/839
4,834,681 A 5/1989 Chaillot
4,938,720 A * 7/1990 Romak ..... H01R 13/18 439/745
5,288,252 A * 2/1994 Steinhardt ..... H01R 13/18 439/839
5,295,873 A * 3/1994 Walbrecht ..... H01R 13/18 439/839
5,338,229 A * 8/1994 Egenolf ..... H01R 13/18 439/839
5,360,356 A * 11/1994 May ..... H01R 13/18 439/839
5,362,262 A * 11/1994 Hotea ..... H01R 13/18 439/839
5,437,566 A * 8/1995 Zinn ..... H01R 13/113 439/839
5,468,163 A * 11/1995 Egenolf ..... H01R 13/18 439/839

(Continued)

*Primary Examiner* — Gary F Paumen
(74) *Attorney, Agent, or Firm* — MacMillan, Sobanski & Todd, LLC

(57) ABSTRACT

A female electrical terminal includes a contact piece and a spring piece. The contact piece includes contact arms that extend from a contact base on opposite sides of a terminal axis in an insertion direction to respective arm ends. The contact piece also includes at least one contact latch. The spring piece includes spring arms that extend from a spring base on opposite sides of the terminal axis. The spring arms bias the contact arms toward the terminal axis. The spring piece also includes at least one engagement tab that extends from the spring base. The engagement tab includes a spring latch that is engaged with the contact latch to prevent movement of the spring piece relative to the contact piece in the insertion direction.

18 Claims, 4 Drawing Sheets

(56) References Cited

U.S. PATENT DOCUMENTS

| | | | | |
|---|---|---|---|---|
| 5,573,434 | A * | 11/1996 | Ittah | H01R 13/113 439/839 |
| 5,683,274 | A * | 11/1997 | Straeb | H01R 13/18 439/839 |
| 5,954,548 | A * | 9/1999 | Stabroth | H01R 13/434 439/748 |
| 6,126,495 | A * | 10/2000 | Lolic | H01R 13/18 439/752.5 |
| 7,252,564 | B1 | 8/2007 | Morello et al. | |
| 7,658,645 | B1 | 2/2010 | Morello et al. | |
| 7,892,050 | B2 * | 2/2011 | Pavlovic | H01R 9/245 439/250 |
| 8,187,033 | B2 | 5/2012 | Feldman et al. | |
| 8,616,924 | B2 | 12/2013 | Ishida | |
| 8,764,486 | B2 | 7/2014 | Ii | |
| 8,944,860 | B2 | 2/2015 | Mulot et al. | |
| 8,998,657 | B1 | 4/2015 | Von Eckroth et al. | |
| 9,119,130 | B2 | 8/2015 | Hui et al. | |
| 9,136,660 | B2 | 9/2015 | Kato | |

* cited by examiner

TWO PIECE CLEAN BODY FEMALE ELECTRIC TERMINAL

BACKGROUND OF THE INVENTION

This invention relates in general to a female electrical terminal. In particular, this invention relates to a two piece clean body female electrical terminal that includes a spring that biases the contact arms inwardly.

A pin or lance style electrical connector includes a male terminal, having an elongated lance made of a conductive material, and a corresponding female terminal, having a plurality of contact arms made of a conductive material. To mate the male terminal and the female terminal, the lance is inserted between the contact arms and pushes them apart. The contact arms press against the lance in order to maintain an electrical connection between the male terminal and the female terminal.

The force with which the contact arms engage the lance determines a terminal retention force, which is the amount of force that is needed to pull the male terminal out of engagement with the female terminal. In some instances, it is desirable to increase the terminal retention force. This may be desirable, for example, when the female terminal is expected to heat up during use, which will cause the conductive material to become softer. As the material softens, the terminal retention force may decrease. This reduction in the terminal retention force could lead to a reduced reliability in the electrical contact between the male terminal and the female terminal.

The terminal retention force can be increased by adding a spring element to the female terminal to create a two-piece female connector. An example of such a two-piece female terminal is disclosed in U.S. Pat. No. 7,892,050, the disclosure of which is incorporated herein by reference. The spring element is typically made of a material that has better spring characteristics than the conductive material, at least at higher temperatures. A typical two-piece female connector includes a contact piece made of copper or aluminum that includes one or more pairs of forwardly extending contact arms. A spring piece made of stainless steel includes forwardly extending spring arms that press the contact arms inwardly toward each other.

Electrical terminals are used in a variety of applications and in a variety of different environments. In order to protect electrical terminals from water or other contaminants, various types of seals may be used. One type of seal commonly used with electrical terminals is a mat seal used in an electrical connector. Electrical connectors are housings that hold one or more electrical terminals, and corresponding connectors are mated to mate the held terminals. A mat seal is a mat of elastomeric material that is held in the electrical connector. The female terminal is positioned adjacent to the mat, and the mat includes openings that the male lance extends through in order to mate with the female terminal.

The previously described two-piece female terminal is typically not used in combination with a mat seal. Rather, a clean body female terminal is typically used in combination with a mat seal. An example of a clean body female terminal is disclosed in U.S. Pat. No. 4,834,681, the disclosure of which is also incorporated herein by reference. The clean body female terminal includes a box-shaped housing with contact arms that are located within the box. When the male lance mates with the clean body female terminal, it enters from the front of the box and extends into the box between the contact arms.

The clean body female terminal offers some advantages over the two-piece female terminal. The outer shape of the clean body female terminal is the box structure, which provides a stable shape that is able to mate with the mat seal. Additionally, the contact arms extend back and into the box, which means the ends of the contact arms are not in a position to accidentally engage with the mat seal and damage the seal. Also, because the contact arms are located within the box, the box protects the contact arms from damage during handling and assembly. It would be advantageous to have a female terminal that provides the advantages of the clean body female terminal, while also providing the advantages of the two-piece terminal.

SUMMARY OF THE INVENTION

This invention relates to a female electrical terminal. The female electrical terminal includes a contact piece. The contact piece includes contact arms that extend from a contact base on opposite sides of a terminal axis in an insertion direction to respective arm ends. The contact piece also includes at least one contact latch. The female electrical terminal also includes a spring piece. The spring piece includes spring arms that extend from a spring base on opposite sides of the terminal axis. The spring arms bias the contact arms toward the terminal axis. The spring piece also includes at least one engagement tab that extends from the spring base. The engagement tab includes a spring latch that is engaged with the contact latch to prevent movement of the spring piece relative to the contact piece in the insertion direction.

This invention also relates to a female electrical terminal. The female electrical terminal includes a contact piece. The contact piece includes a contact base located around a terminal axis. Contact arms extend from the contact base on opposite sides of a terminal axis in an insertion direction. Contact latches extend from the contact base on opposite sides of the terminal axis. The female electrical terminal also includes a spring piece. The spring piece includes a spring base located around the terminal axis. Spring arms extend from the spring base on opposite sides of the terminal axis. The spring arms bias the contact arms toward the terminal axis. Engagement tabs extend from the spring base on opposite sides of the terminal axis. The engagement tabs include spring latches that are engaged with the contact latches to prevent movement of the spring piece relative to the contact piece in the insertion direction.

This invention further relates to a female electrical terminal. The female electrical terminal includes a contact piece. The contact piece includes a contact base that is a four-sided structure located around a terminal axis. Contact arms extend from the contact base on opposite sides of the terminal axis in an insertion direction. Contact latches also extend from the contact base on opposite sides of the terminal axis. The female electrical terminal also includes a spring piece. The spring piece includes a spring base that is a second four-sided structure located around the terminal axis. The spring base is located adjacent to the contact base in the insertion direction. Spring arms extend from the spring base on opposite sides of the terminal axis. The spring arms bias the contact arms toward the terminal axis. Engagement tabs extend from the spring base on opposite sides of the terminal axis. The engagement tabs are cantilevered from the spring base. The engagement tabs include spring latches. The spring latches are engaged with the contact latches to prevent movement of the spring piece relative to the contact piece in the insertion direction.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
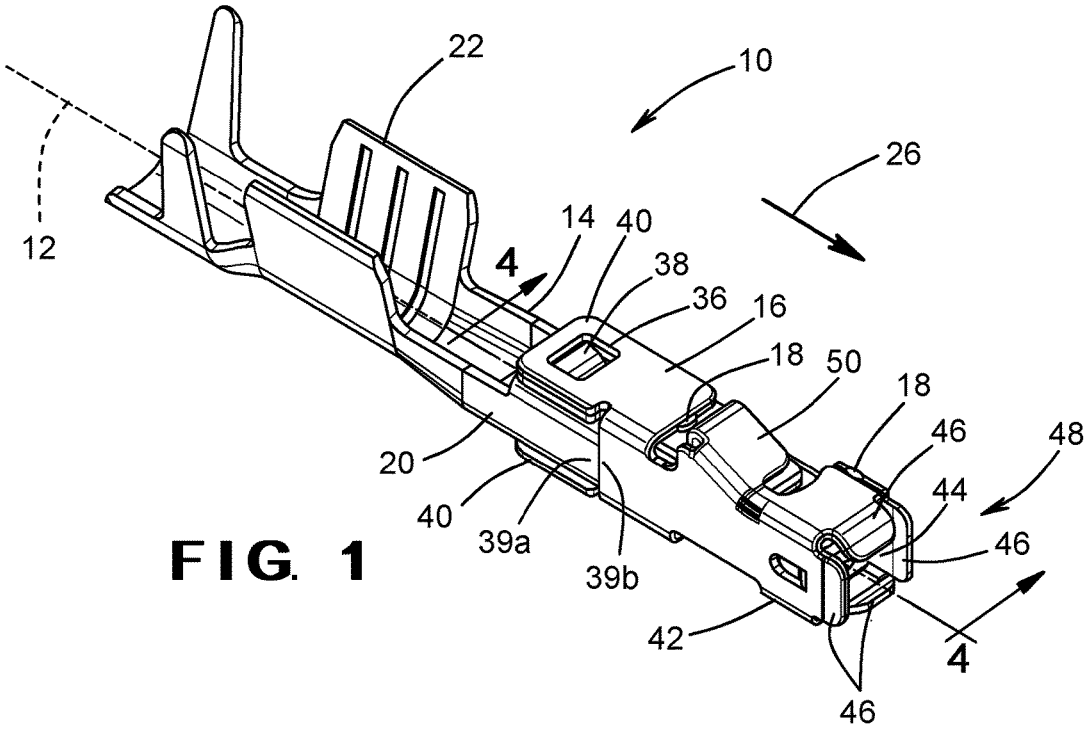
FIG. 1 is a front upper perspective view of a two piece clean body female terminal and spring in accordance with this invention.
Figure 2:
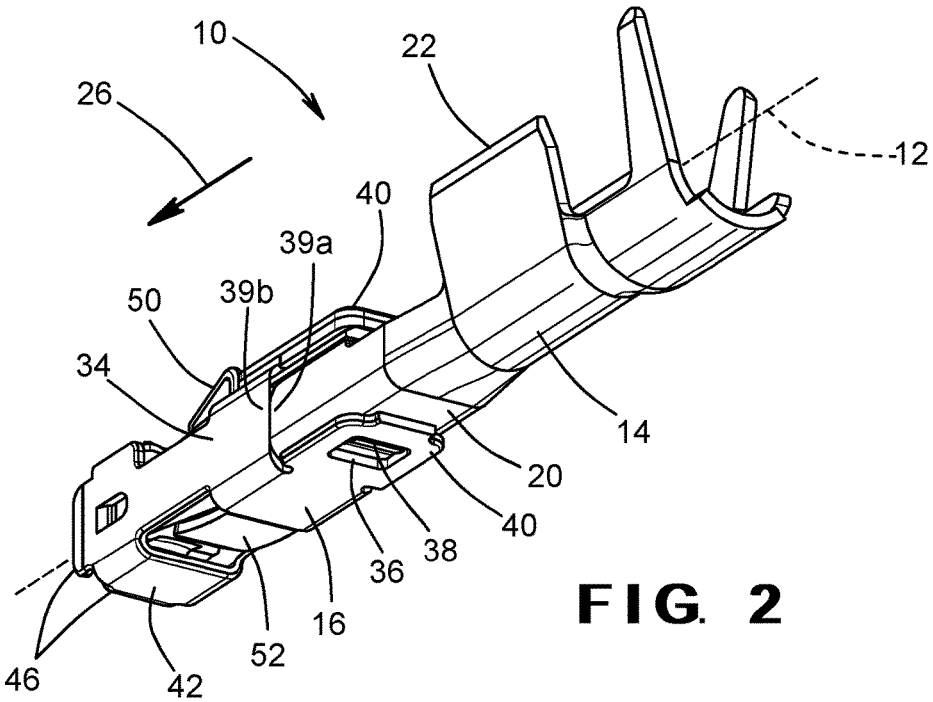
FIG. 2 is a rear lower perspective view of the two piece clean body female terminal and spring illustrated in FIG. 1.

Referring now to the drawings, there is illustrated in FIGS. 1 and 2 a female terminal, indicated generally at 10. The female terminal 10 constitutes one half of an electrical terminal pair and is configured to mate with a corresponding male terminal (not shown) that is inserted along a terminal axis 12, in a manner that is well-known in the art. The illustrated female terminal 10 is adapted to mate with a male terminal that is 1.2 mm wide, but may be adapted to mate with any desired size male terminal.

The illustrated female terminal 10 is a two-piece terminal that includes a contact piece 14 and a spring piece 16. The illustrated contact piece 14 is made of aluminum and includes a tin plate layer, but may be made of any desired material and may include any desired plate layers or no plate layers. The illustrated contact piece 14 is made from a piece of stamped material that is folded into the illustrated shape, but may be made by any desired method. The illustrated spring piece 16 is made of stainless steel, but may be made of any desired material. The illustrated spring piece 16 is made from a piece of stamped material that is folded into the illustrated shape, but may be made by any desired method. A plurality of retainers 18 are provided to retain the spring piece 16 in its illustrated shape. The illustrated retainers 18 are laser welds, but may be any desired type of retainer. The illustrated spring piece 16 includes two retainers 18, but any desired number and placement of the retainers 18 may be used.

Figure 3:
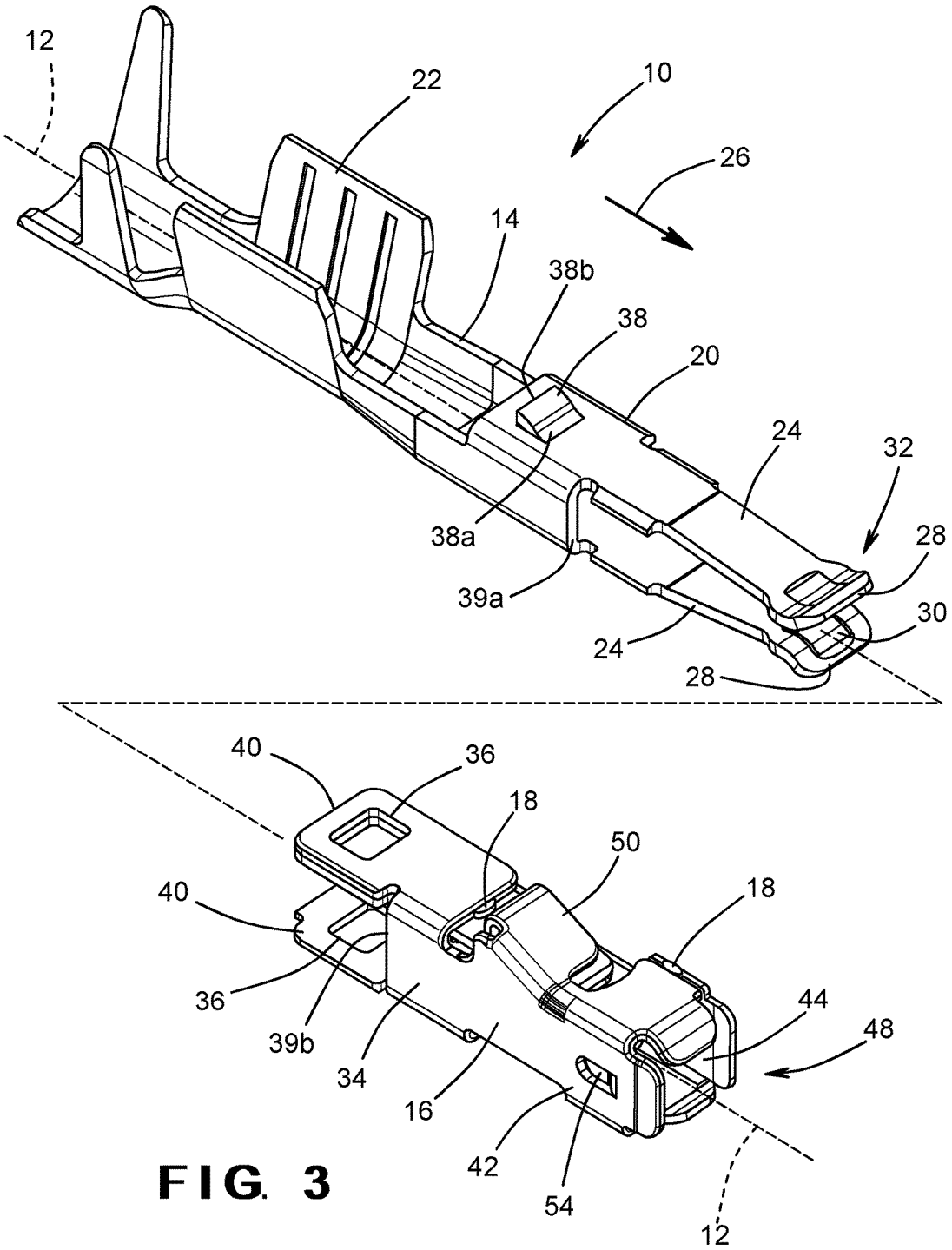
FIG. 3 is an exploded front upper perspective view of the two piece clean body female terminal and spring illustrated in FIGS. 1 and 2 shown prior to assembly.

Referring to FIG. 3, a perspective view of the contact piece 14 separate from the spring piece 16 is illustrated, prior to their assembly into the female terminal 10. The contact piece 14 includes a contact base 20. The illustrated contact base 20 is a four-sided structure located around the terminal axis 12, but the contact base 20 may have any desired shape. The contact piece 14 also includes a connection portion 22 that extends from the contact base 20. The illustrated connection portion 22 is adapted to be crimped onto a wire, as is known in the art. However, the connection portion 22 may be any desired type of connector.

The contact piece 14 further includes a plurality of contact arms 24 that extend from the contact base 20 in an insertion direction 26 to respective arm ends 28. The contact arms 24 are located on opposite sides of the terminal axis 12. The illustrated female terminal 10 includes two contact arms 24, but may include any desired number of contact arms 24. Each contact arm 24 includes a contact area 30, which is the part of the contact arm 24 that is adapted to engage the corresponding male terminal. The illustrated contact piece 14 includes a gap, indicated at 32, between the contact areas 30 of the two contact arms 24. However, the contact arms 24 may be in contact with each other, if desired.

The spring piece 16 includes a spring base 34. The illustrated spring base 34 is a four sided structure located around the terminal axis 12, but the spring base 34 may have any desired shape. The spring piece 16 includes two spring latches 36 that cooperate with respective contact latches 38 on the contact piece 14 to help retain the spring piece 16 in position relative to the contact piece 14. The illustrated spring latches 36 are openings that extend through engagement tabs 40 that extend from the spring base 34. The engagement tabs 40 may be cantilevered from the spring base 34, being connected at only one end as shown. The illustrated spring piece 16 includes two engagement tabs 40, located on opposite sides of the terminal axis 12. However, the spring piece 16 may include any desired number of engagement tabs 40.

The illustrated contact latches 38 are tongues that extend from the contact base 20 away from the terminal axis 12. The illustrated contact latches 38 are cut from the contact piece 14 and are bent away from the terminal axis 12. The contact latches 38 include sloped surfaces **38*a* on the insertion direction 26 side of the contact latches 38. The sloped surfaces 38*a* are at an acute angle to the terminal axis 12. The contact latches 38 also include stop surfaces 38*b* on the side opposite the insertion direction 26. The stop surfaces 38*b* are generally perpendicular to the terminal axis 12**.

When the female terminal 10 is assembled, the contact piece 14 is moved in the insertion direction 26 relative to the spring piece 16. Each engagement tab 40 on the spring piece 16 is located adjacent to and outside the contact base 20 and engages one of the contact latches 38. Each engagement tab 40 engages the respective sloped surface **38*a* and the engagement tabs 40 are deflected outwardly, away from the terminal axis 12. As the contact piece 14 is moved farther in the insertion direction 26, the openings 36 in the engagement tabs 40 will be located adjacent to the respective contact latch 38, and the engagement tabs 40 will rebound back inwardly toward the terminal axis 12. The spring piece 16 is then in an assembled position relative to the contact piece 14**.

When the spring piece 16 is in the assembled position relative to the contact piece 14, each spring latch 36 is engaged with the respective contact latch 38. If the contact piece 14 is moved relative to the spring piece 16 in the direction opposite to the insertion direction 26, the engagement tabs 40 will engage the stop surfaces **38*b*, which prevent the contact piece 14 from moving relative to the spring piece 16. Although one embodiment of the spring latches 36 and contact latches 38 have been described, it should be appreciated that the spring latches 36 and the contact latches 38 may be any desired structure or retainer. Additionally, the female terminal 10 may include any desired number of spring latches 36 and contact latches 38**.

The contact piece 14 includes contact blocks **39*a*, and the spring piece 16 includes spring blocks 39*b*. The illustrated contact blocks 39*a* are leading edges of the contact base 20, but may be any desired structure. The illustrated spring blocks 39*b* are trailing edges of the spring base 34, but may be any desired structure. When the spring piece 16 is in the assembled position relative to the contact piece 14, the spring blocks 39***b* engage the contact blocks 39*a* to prevent movement of the contact piece 14 relative to the spring piece 16 in the insertion direction 26. As best seen in FIGS. 1 and 2, when the illustrated female terminal 10 is assembled, the spring base 34 is located adjacent to the contact base 20 in the insertion direction 26. Relative movement of the contact piece 14 and the spring piece 16 is prevented by the engagement of the spring latch 36 with the respective contact latch 38, and also by the engagement of the contact block 39*a* with the respective spring block 39*b*.

Figure 4:
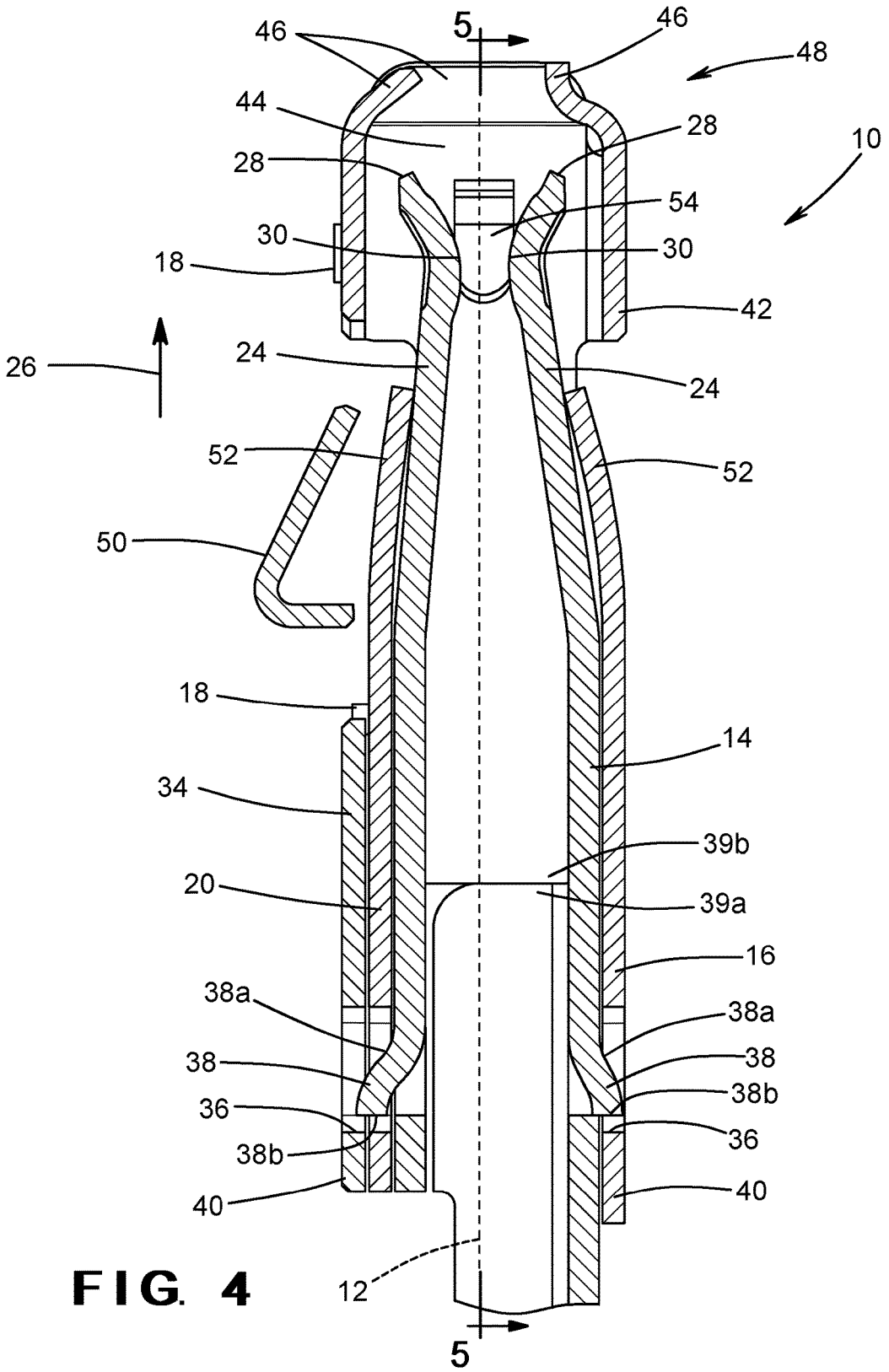
FIG. 4 is a cross-sectional view of the assembled two piece clean body female terminal and spring taken along line 4-4 of FIG. 1.

The spring piece 16 includes a cage 42 that extends from the spring base 34 in the insertion direction 26. The cage 42 includes a four-sided structure that is located around the arm ends 28 of the contact arms 24. The cage 42 extends farther in the insertion direction 26 than the contact arms 24, as best shown in FIG. 4. Thus, the cage 42 provides physical protection for the contact arms 24 and helps prevent the contact arms 24 from being damaged during handling and installation of the female terminal 10.

The cage 42 defines an insertion opening 44 that is located around the terminal axis 12. When the corresponding male terminal is mated with the female terminal 10, it is inserted through the insertion opening 44. The cage 42 includes a plurality of guards 46 that are located around the insertion opening 44. Each of the guards 46 extends from one side of the four-sided structure of the cage 42, and each extends in the insertion direction 26 and toward the terminal axis 12. As best shown in FIG. 3, the guards 46 provide the female terminal 10 with a tapered insertion end, indicated generally at 48, wherein the cross-sectional shape of the female connector 10 reduces in size moving in the insertion direction 26 toward the end of the female terminal 10.

The female terminal 10 also includes an optional polarizer 50. The polarizer 50 is a raised portion of the spring piece 16 that acts as a poka-yoke to limit the orientation at which the female terminal 10 can be inserted into a housing. The polarizer 50 may also act as a terminal lock to retain the female terminal 10 in the housing after insertion.

Figure 5:
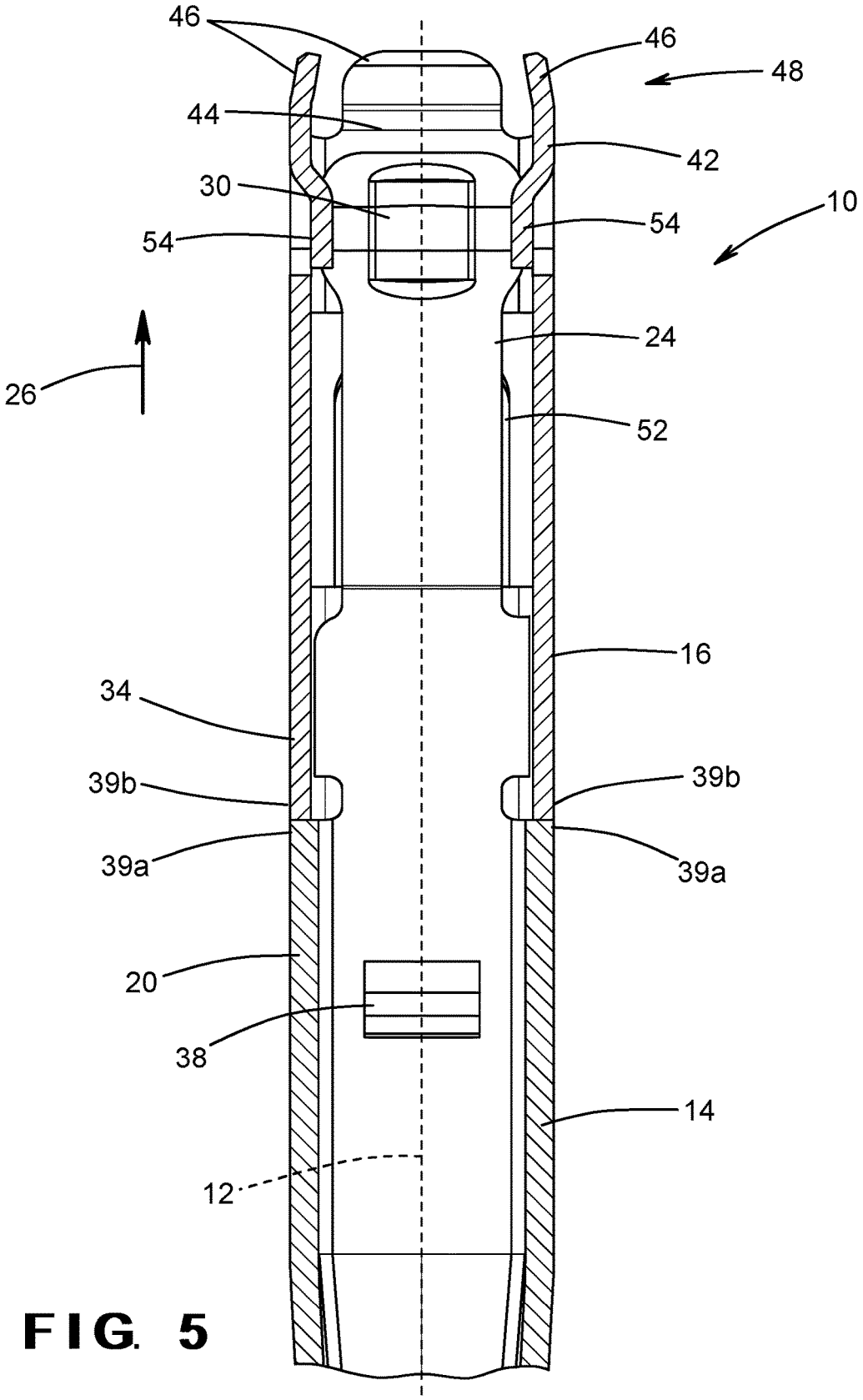
FIG. 5 is a cross-sectional view of the assembled two piece clean body female terminal and spring taken along line 5-5 of FIG. 4.

As best shown in FIGS. 5 and 6, the spring piece 16 includes spring arms 52. The spring arms 52 extend from the spring base 34 in the insertion direction 26. The spring arms 52 are located on opposite sides of the terminal axis 12 and are bent inwardly toward the terminal axis 12 into engagement with the contact arms 24. The illustrated female terminal 10 includes two spring arms 52, but may include any desired number of spring arms 52. The spring arms 52 bias the contact arms 24 toward terminal axis 12, thus increasing the terminal retention force of the female terminal 10.

As also best shown in FIGS. 5 and 6, the female terminal 10 also includes arm limiters 54 that are located in the gap 32 between the contact arms 24. The arm limiters 54 serve to limit the movement of the contact arms 24 toward the terminal axis 12 and toward each other. The arm limiters 54 also maintain the gap 32 between the contact arms 24 by preventing the contact arms 24 from moving closer to each other. The illustrated arm limiters 54 extend from the spring piece 16, but the arm limiters 54 may be located on any desired part of the female terminal 10. Additionally, the illustrated female terminal 10 includes two arm limiters 54 located on opposite sides of the terminal axis 12, but the female terminal 10 may include any desired number of arm limiters 54.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A female electrical terminal comprising:

a contact piece including contact arms that extend from a contact base on opposite sides of a terminal axis in an insertion direction to respective arm ends, the contact piece also including at least one contact latch; and a spring piece including spring arms that extend from a spring base on opposite sides of the terminal axis and bias the contact arms toward the terminal axis, the spring piece also including at least one engagement tab that extends from the spring base and includes a spring latch that is engaged with the contact latch to prevent movement of the spring piece relative to the contact piece in the insertion direction, wherein either:

(1) the engagement tab is cantilevered from the spring base; or (2) the contact latch extends from the contact base away from the terminal axis, and the spring latch is an opening in the engagement tab.

2. The female electrical terminal of claim 1, wherein the spring base is located adjacent to the contact base in the insertion direction.

3. The female electrical terminal of claim 1, wherein the spring piece further includes a cage that extends from the spring base and is located around the arm ends.

4. The female electrical terminal of claim 1, wherein the contact base is located around the terminal axis, and wherein the spring base is located around the terminal axis.

5. The female electrical terminal of claim 1, wherein the engagement tab extends from the spring base in a direction opposite the insertion direction.

6. The female electrical terminal of claim 1, wherein the engagement tab is located outside the contact base.

7. The female electrical terminal of claim 1, wherein the engagement tab is a first engagement tab, and the spring piece includes a second engagement tab that extends from the spring base on the opposite side of the terminal axis from the first engagement tab.

8. The female electrical terminal of claim 7, wherein the first engagement tab and the second engagement tab are cantilevered from the spring base.

9. The female electrical terminal of claim 1, wherein the engagement tab is cantilevered from the spring base.

10. The female electrical terminal of claim 1, wherein the contact latch extends from the contact base away from the terminal axis, and wherein the spring latch is an opening in the engagement tab.

11. The female electrical terminal of claim 10, wherein the contact latch includes a sloped surface on a side of the contact latch in the insertion direction and a stop surface on a side of the contact latch opposite the insertion direction.

12. The female electrical terminal of claim 1, wherein the engagement tab is a first engagement tab, and wherein the spring piece includes a second engagement tab that extends from the spring base on the opposite side of the terminal axis from the first engagement tab.

13. The female electrical terminal of claim 1, wherein the contact base is a four-sided structure located around the terminal axis, and wherein the spring base is a second four-sided structure located around the terminal axis.

14. The female electrical terminal of claim 1, wherein the spring piece further includes arm limiters that extend between the contact arms.

15. A female electrical terminal comprising:

a contact piece including a contact base located around a terminal axis, contact arms that extend from the contact base on opposite sides of the terminal axis in an insertion direction, and contact latches that extend from the contact base on opposite sides of the terminal axis; and a spring piece including a spring base located around the terminal axis, spring arms that extend from the spring base on opposite sides of the terminal axis and bias the contact arms toward the terminal axis, and engagement tabs that extend from the spring base on opposite sides of the terminal axis, the engagement tabs including spring latches that are engaged with the contact latches to prevent movement of the spring piece relative to the contact piece in the insertion direction, wherein the contact latches extend from the contact base away from the terminal axis, and the spring latches are openings in the engagement tabs.

16. The female electrical terminal of claim 15, wherein the engagement tabs are cantilevered from the spring base.

17. A female electrical terminal comprising:

a contact piece including a contact base that is a four-sided structure located around a terminal axis, contact arms that extend from the contact base on opposite sides of the terminal axis in an insertion direction, and contact latches that extend from the contact base on opposite sides of the terminal axis; and a spring piece including a spring base that is a second four-sided structure located around the terminal axis and located adjacent to the contact base in the insertion direction, spring arms that extend from the spring base on opposite sides of the terminal axis and bias the contact arms toward the terminal axis, and engagement tabs that extend from the spring base on opposite sides of the terminal axis and are cantilevered from the spring base, the engagement tabs including spring latches that are engaged with the contact latches to prevent movement of the spring piece relative to the contact piece in the insertion direction.

18. The female electrical terminal of claim 17, wherein the contact latches extend from the contact base away from the terminal axis, and the spring latches are openings in the engagement tabs.

* * * * *